US005435230A

United States Patent [19]

Phillips

[11] Patent Number: 5,435,230

[45] Date of Patent: Jul. 25, 1995

[54] INFLATION MECHANISM

[75] Inventor: Matthew L. Phillips, North Easton, Mass.

[73] Assignee: Reebok International Ltd., Stoughton, Mass.

[21] Appl. No.: 182,007

[22] PCT Filed: Aug. 5, 1991

[86] PCT No.: PCT/US91/05559

§ 371 Date: Apr. 12, 1994

§ 102(e) Date: Apr. 12, 1994

Related U.S. Application Data

[63] Continuation-in-part of Ser. No. 731,761, Jul. 15, 1991, Pat. No. D. 340,346, which is a continuation-in-part of Ser. No. 732,228, Jul. 15, 1991, abandoned.

[51] Int. Cl.[6] ..... F01B 19/00

[52] U.S. Cl. ..... 92/91; 417/437; 92/90

[58] Field of Search ..... 92/89, 90, 91, 92; 417/437, 474

[56] References Cited

U.S. PATENT DOCUMENTS

| | | | |
|---|---|---|---|
| 1,637,219 | 7/1927 | Edelmann . | |
| 2,717,556 | 9/1955 | Bartoo . | |
| 2,775,401 | 12/1956 | Storrs . | |
| 2,845,032 | 7/1958 | Krohm . | |
| 3,494,343 | 2/1970 | Nutten | 92/90 |
| 5,056,992 | 10/1991 | Simons et al. . | |

FOREIGN PATENT DOCUMENTS

| | | | |
|---|---|---|---|
| 726442 | 1/1966 | Canada | 92/90 |
| 2365329 | 9/1974 | Germany . | |
| 3811698 | 10/1989 | Germany . | |

*Primary Examiner*—Thomas E. Denion

*Attorney, Agent, or Firm*—Sterne, Kessler, Goldstein & Fox

[57] ABSTRACT

An inflation mechanism which comprises an inflation head and a sidewall connected by a living hinge or weakened area which permits the inflation head to invert within the interior chamber of the sidewall during compression of the inflation mechanism thereby permitting a high volume of fluid displacement.

20 Claims, 6 Drawing Sheets

INFLATION MECHANISM

CROSS REFERENCE TO RELATED APPLICATIONS

This application is a continuation-in-part of (now U.S. Pat. No. Des. 340,346) U.S. patent application Ser. Nos. 07/731,761 and 07/732,228 filed Jul. 15, 1991., now abandoned.

BACKGROUND

1. Field of the Invention

The present invention relates generally to an improved inflation mechanism and, more particularly, to an inflation mechanism for maximizing fluid displacement.

2. Background of the Invention

The use of devices inflatable with a fluid such as air is widespread in various articles of manufacture. For example, inflatable devices are now commonly used in a variety of articles as diverse as footwear, furniture (e.g., air mattresses), apparel and athletic equipment (e.g., helmets and protective pads). Such inflatable devices incorporate a bladder or other air-tight chamber which is inflated by an inflation mechanism disposed on the article (i.e., "on-board") or by an inflation mechanism separate from the article.

When using an on-board inflation mechanism, it is important that the mechanism be as small as reasonably possible to minimize interference with the intended use of the article. However, a reduction in the size of the mechanism can result in a decrease in its fluid displacement capability. In general, the smaller the inflation mechanism, the less fluid which can be displaced upon compression. This is a particular problem if the mechanism is not efficient, i.e., it does not provide a high compression ratio (the ratio of the total volume of fluid in the mechanism prior to compression to the volume of fluid remaining in the inflation mechanism after the mechanism is compressed). A decreased fluid displacement capability requires an increased number of compressions to inflate an associated bladder, thereby decreasing the overall efficiency of the inflatable article. A low compression ratio limits the maximum pressure of that which is being inflated.

Conventional inflation mechanisms are manufactured of rubber or equivalent material which is not particularly aesthetically pleasing. Thus, .a flexible plastic cover carrying a logo, for example, is commonly provided over the mechanism. The friction between the inflation mechanism and cover requires an increased effort during pumping. Therefore, the need exists for an efficient yet lightweight inflation mechanism which serves as its own cover and which can be disposed on a variety of articles of manufacture.

SUMMARY OF THE INVENTION

The inflation mechanism of the present invention has been designed to fulfill the aforementioned need. As such, the present invention comprises an inflation mechanism comprising a sidewall defining a fluid-filled interior chamber, an inflation head and flexure means disposed between the sidewall and the inflation head. The flexure means allows the inflation head to invert within the interior chamber while maintaining the integrity of the sidewall, thereby displacing fluid disposed within said chamber. The flexure means may comprise a weakened area which may be a groove. The groove may extend along the entire periphery of the sidewall. The fluid may be air. The inflation mechanism may be incorporated in an inflation system including a bladder. The inflation mechanism is designed so as to be aesthetically tolerable on the outside of an article, thus removing the need for a second cosmetic cover which would otherwise impair the pumping function of the mechanism. Furthermore, because the inflation mechanism serves as its own cover, eliminating the need for a separate interior inflation device, it is better suited for mass production of articles of manufacture by minimizing the steps necessary to produce the articles.

BRIEF DESCRIPTION OF THE DRAWINGS

The foregoing and other aspects and features of the present invention will be more fully appreciated as the same becomes better understood from the following detailed description of the present invention when considered in conjunction with the accompanying drawings, in which.

DETAILED DESCRIPTION OF THE PREFERRED EMBODIMENTS

Figure 1:
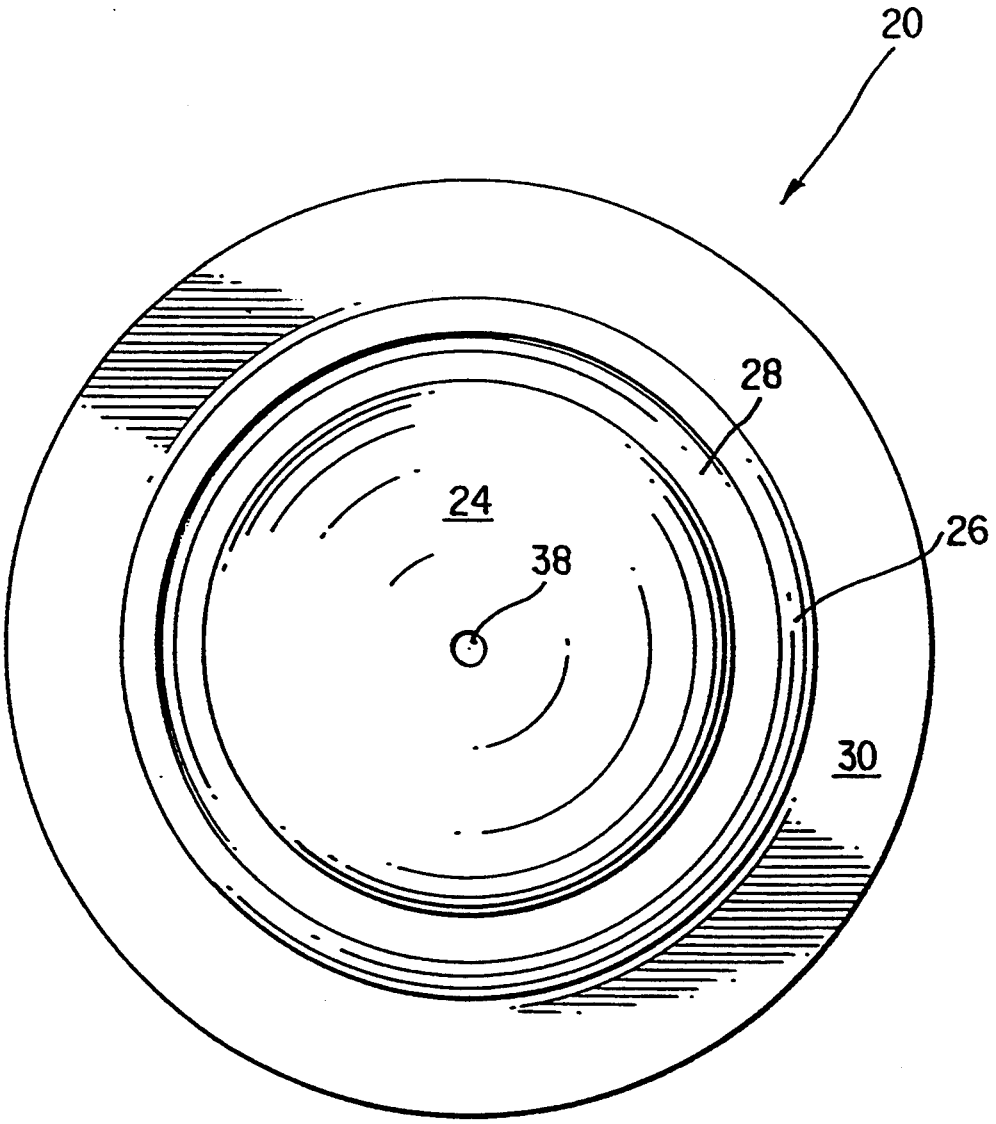
FIG. 1 is a top view of the inflation mechanism of the present invention.

Referring now to the drawings, the preferred embodiments of the present invention will now be described. Throughout the specification, representative values for the dimensions of the present invention are presented. It is to be understood that these values are not to be considered as limitations of the present invention.

Figure 2:
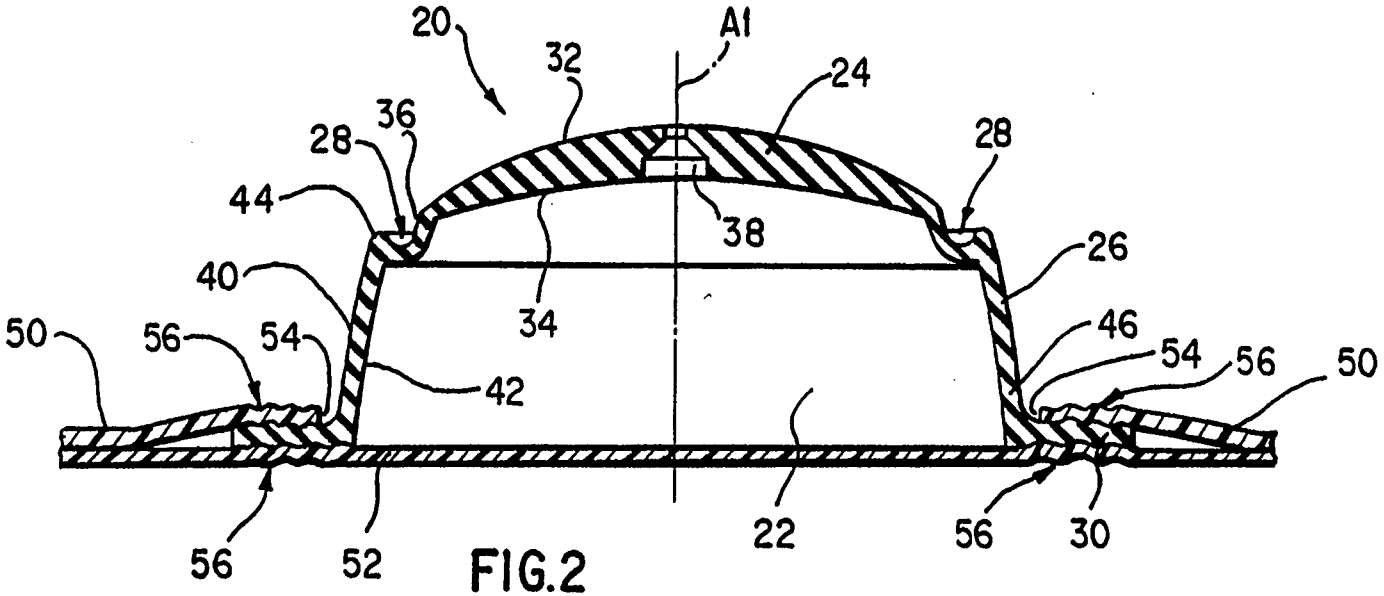
FIG. 2 is a cross-sectional view of the same taken along line 2—2 in FIG. 1 and including a portion of a bladder.
Figure 3:
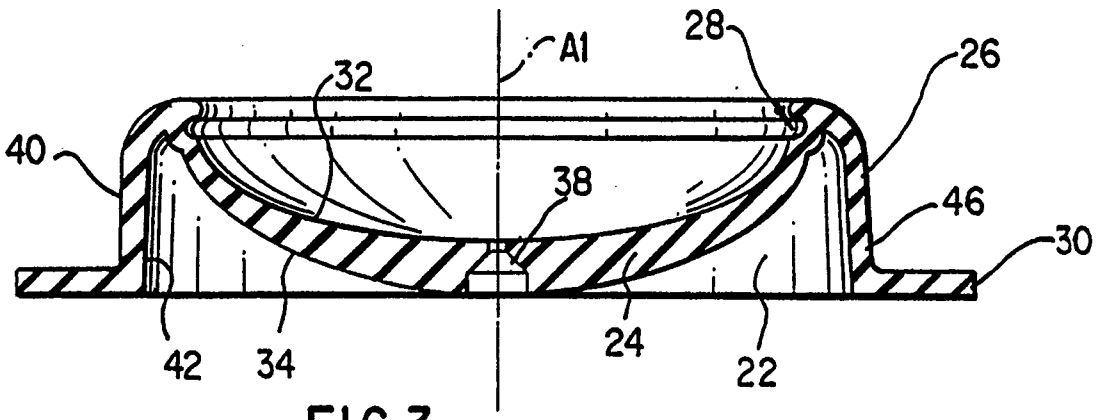
FIG. 3 is a cross-sectional view of the present invention upon the application of a force.

Beginning with FIGS. 1, 2, and 3, inflation mechanism 20 is shown. Mechanism 20 is piston-like, such that upon the application of a force directed substantially along its central axis A1, air is forced to a bladder (or other fluid receiving chamber).

Inflation mechanism 20 generally comprises four elements: an inflation head 24, a sidewall 26, flexure means 28 and an outer lip 30. Each of these elements will now be described in greater detail.

Inflation head 24 is circular in plan and has a thickness defining an outer surface 32 and an inner surface 34. As best seen in FIG. 2, inflation head 24 is generally crescent shaped in cross section tapering from a greatest thickness proximate axis A1 to a minimum thickness proximate the area 36 where inflation head 24 joins flexure means 28. The ratio of the radius of curvature of outer surface 32 to inner surface 34 is approximately 0.60. Inflation head 24 defines a hole 38 which extends through inflation head 24 in substantial alignment with central axis A1. Hole 38 increases in diameter from outer surface 32 to inner surface 34. Hole 38 controls access of air (or other fluid) to interior chamber 22 of inflation mechanism 20. When inflation head 24 is depressed (as shown in FIG. 3), that which depresses head 24 covers hole 38 preventing the escape of air from within chamber 22 other than into an associated bladder. When that which depresses inflation head 24 is removed, air is allowed to freely enter hole 38. Thus, hole 38 acts as a one-way valve when closed during compression.

Sidewall 26 is generally cylindrical in horizontal cross-section, having a sidewall outer surface 40 and a sidewall inner surface 42. Surfaces 40, 42 are angled from outer lip 30 toward inflation head 24 such that the ratio of curvature of outer surface 40 to inner surface 42 is approximately 1.01. Sidewall 26 terminates along outer surface 40 at curved outer surface 44; Although inflation mechanism 20 is shown as having a single cylindrical sidewall 26, it is to be understood that other shapes and a greater number of sidewalls may also be used.

Outer lip 30 is circular in plan and joins sidewall 26 at a bottom area 46. Lip 30 allows inflation mechanism 20 to be attached to a bladder or other chamber by suitable attachment techniques such as RF welding or adhesive, as will be described below.

Flexure means 28 is a weakened area of inflation mechanism 20 extending between sidewall 26 and inflation head 24 along the entire periphery of sidewall, 26. More specifically, flexure means 28 is a concave groove or living hinge which extends on the exterior of inflation mechanism 20 from area 36 of inflation head 24 to curved outer surface 44 of sidewall 26. Flexure means 28 acts as a hinge, which upon the application of downward force along central axis A1, allows inflation head 24 to fully invert within interior chamber 22 while sidewall 26 remains erect.

FIG. 3 depicts inflation mechanism 20 in a completely depressed state. When force is applied downward along central axis A1, sidewall 26 remains erect, but expands outwardly due to flexure means 28 which permits the complete inversion of inflation head 24 within interior chamber 22. When hole 38 is closed, air is displaced from chamber 22. Inflation head 24 moves within sidewall 26 much the same way as a piston moves within a cylinder. This specific geometry enables nearly the entire volume of air within chamber 22 to be compressed when head 24 is in a depressed stated. This provides a high compression ratio to be established. That is, the volume within chamber 22 is minimized when head 24 is fully depressed. Therefore the pressure within chamber 22 is maximized when head 24 is fully depressed. The maximum pressure within chamber 22 defines the maximum pressure of that which is being inflated. Thus, the present invention minimizes the volume in chamber 22 when head 24 is fully depressed. In addition, a maximum amount of fluid is displaced from chamber 22. Thus a greater amount of air or fluid is displaced with a lesser number of compressions.

Inflation mechanism 20 is preferably molded of ESTANE TM, a thermoplastic urethane (TPU) which is available from B. F. Goodrich Company, Inc., although other suitable materials may also be used. One such material is PELLETHANE TM #81880, a TPU available from Dow Chemical Corporation. ESTANE TM and PELLETHANE TM are elastomeric, resilient, and lightweight, chemically resistant, mold and bond well, and take well to pigmentation. ESTANE TM #58863 has a nominal durometer of approximately 80–85 on the Shore A scale. Inflation mechanism 20 is preferably formed from a monolithic piece of material defining interior chamber 22. Chamber 22 may be filled with a foam to assist inflation head 24 in returning to its original configuration following depression. One example is a reticulated, open cell polyurethane foam which has approximately ten to fifty pores per square inch.

As best seen in FIG. 2, inflation mechanism 20 may be incorporated into a bladder or other fluid chamber. For example, inflation mechanism 20 may be sandwiched between thermoplastic sheets 50, 52; sheet 50 having a hole 54 to accommodate inflation mechanism 20. Sheets 50, 52 may then be joined at 56 to outer lip 30 of inflation mechanism 20 and along a periphery of the sheets to form a unitary inflation system incorporating inflation mechanism 20 into a bladder. In the alternative, sheet 50 may be sandwiched between lip 30 and sheet 52 along opening 54 of sheet 50. A release valve may be incorporated into the inflation system to allow the release of air from the bladder. A check valve may also be provided to prevent compressed air (or fluid) from returning from the bladder to inflation mechanism 20. In the alternative, rather than incorporating inflation means 20 directly into a bladder, it may be separate from the bladder and connected thereto by a conduit or channel. Preferably, sheets 50, 52 are blown urethane film available from J. P. Stevens & Co., Inc. under product designation #MP-188. Sheets 50, 52 have a preferred thickness of about 0.005 to 0.050 inch.

In use, the user places a finger or other device over hole 38 and alternately depresses and releases inflation head 24. During depression of inflation mechanism 20, air (or other fluid) is expelled from chamber 22 and flows into a bladder or other chamber. During the release of inflation mechanism 20, hole 38 is uncovered, allowing ambient air (or other fluid) to be drawn through hole 38 to fill chamber 22. This alternate depression and release continues for a sufficient number of times until the bladder or other chamber is inflated to a desired fluid pressure.

Figure 4:
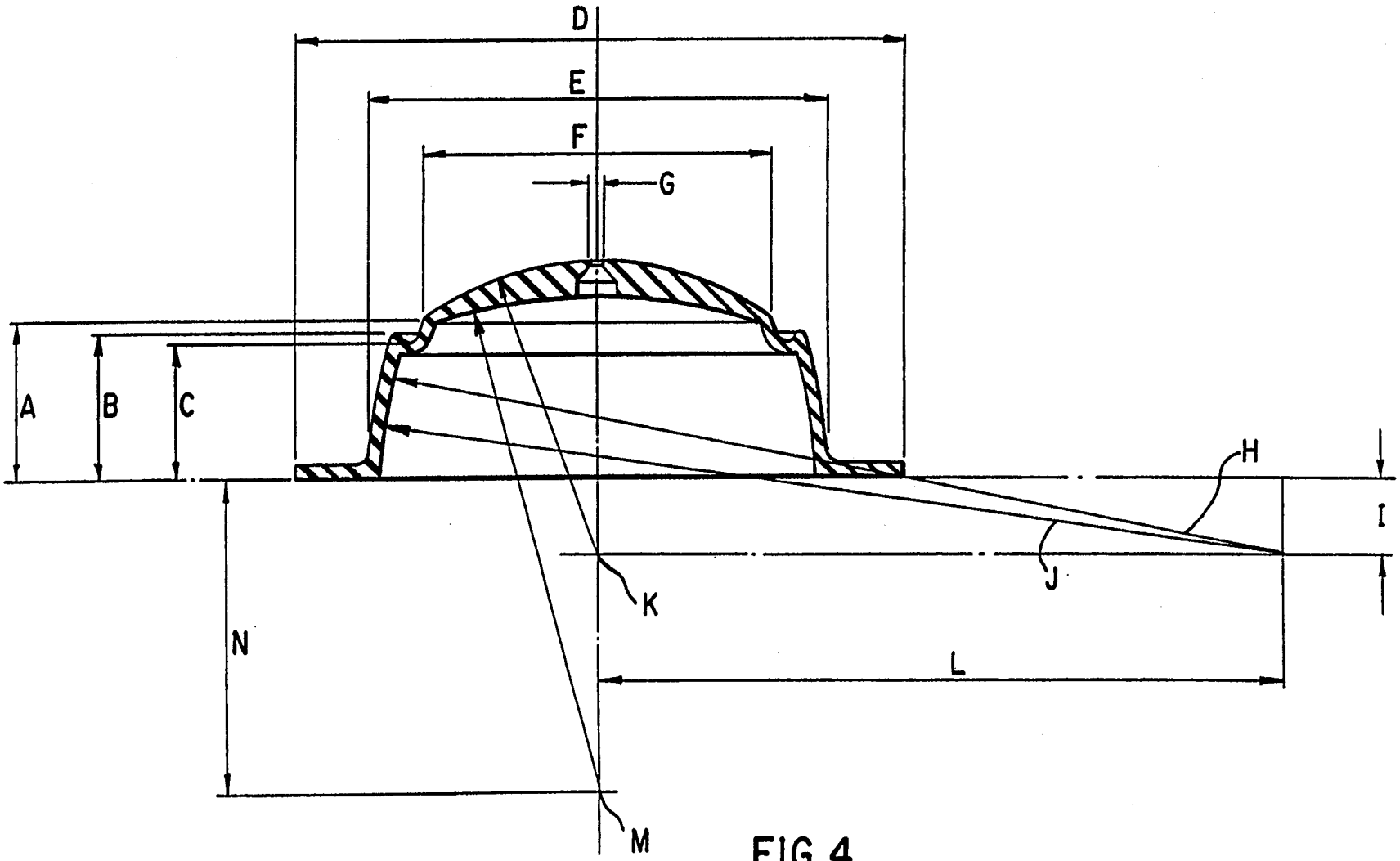
FIG. 4 and 5 are cross-sectional views similar to FIG. 2 showing the geometry of the inflation device.
Figure 5:
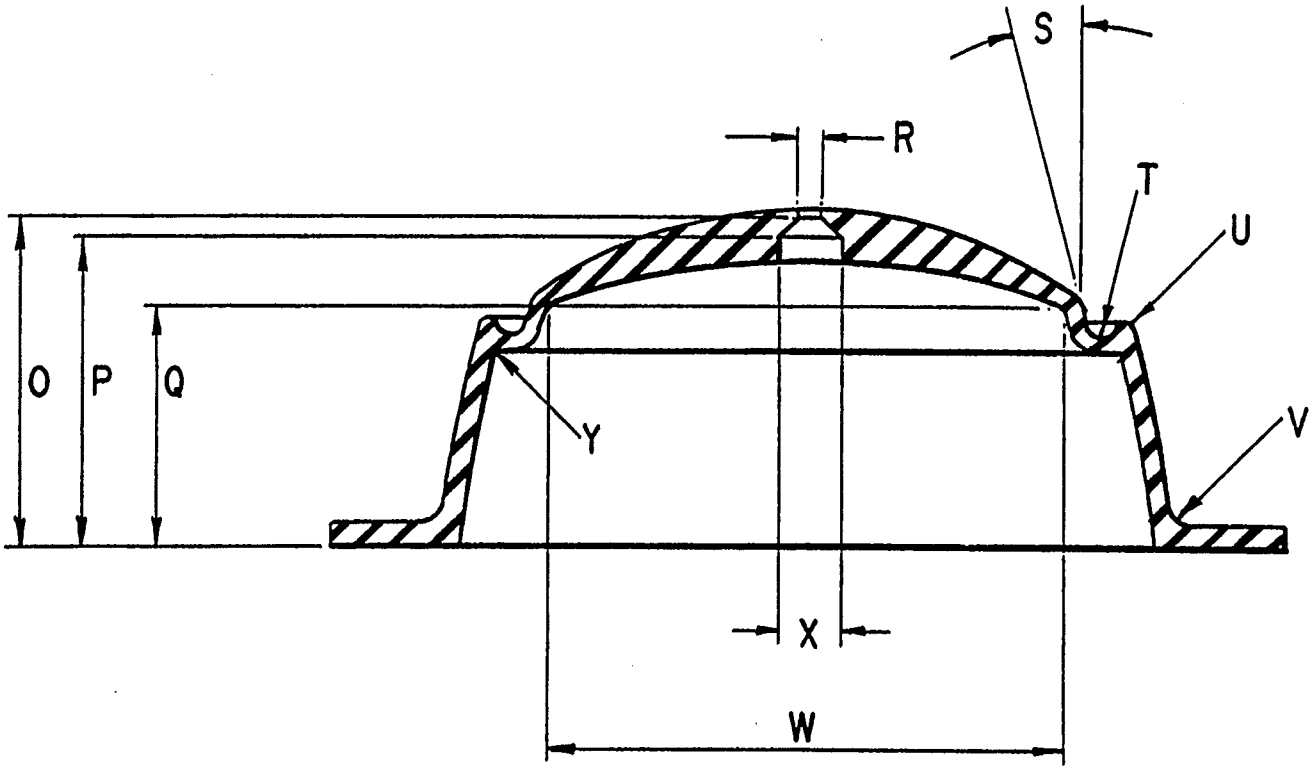

FIGS. 4 and 5 are cross-sectional views of inflation mechanism 20 similar to FIG. 2, showing the preferred geometry of inflation mechanism 20. Approximate values for the dimensions labeled in FIGS. 4 and 5 are provided in the following chart:

| Reference Letter | Dimension (in inches unless otherwise indicated) | Reference Letter | Dimension (in inches unless otherwise indicated) |
|---|---|---|---|
| A | 0.339 | N | 0.672 |
| B | 0.314 | O | 0.455 |
| C | 0.285 | P | 0.423 |
| D | 1.220 | Q | 0.333 |
| E | 0.982 | R | 0.030 |
| F | 0.749 | S | 15° |
| G | 0.030 | T | 0.020 |
| H | 1.945 | U | 0.010 |
| I | 0.1675 | V | 0.039 |
| J | 1.968 | W | 0.706 |
| K | 0.630 | X | 0.094 |
| L | 1.467 | Y | 0.010 |
| M | 1.065 | | |

Reference letters A, B, C, I, L, N, 0, P and Q refer to distances; reference letters D, E, F, G, W and X to diameters; and reference letters H, J, K, M, T, U, V and Y to radii of curvature.

Figure 6:
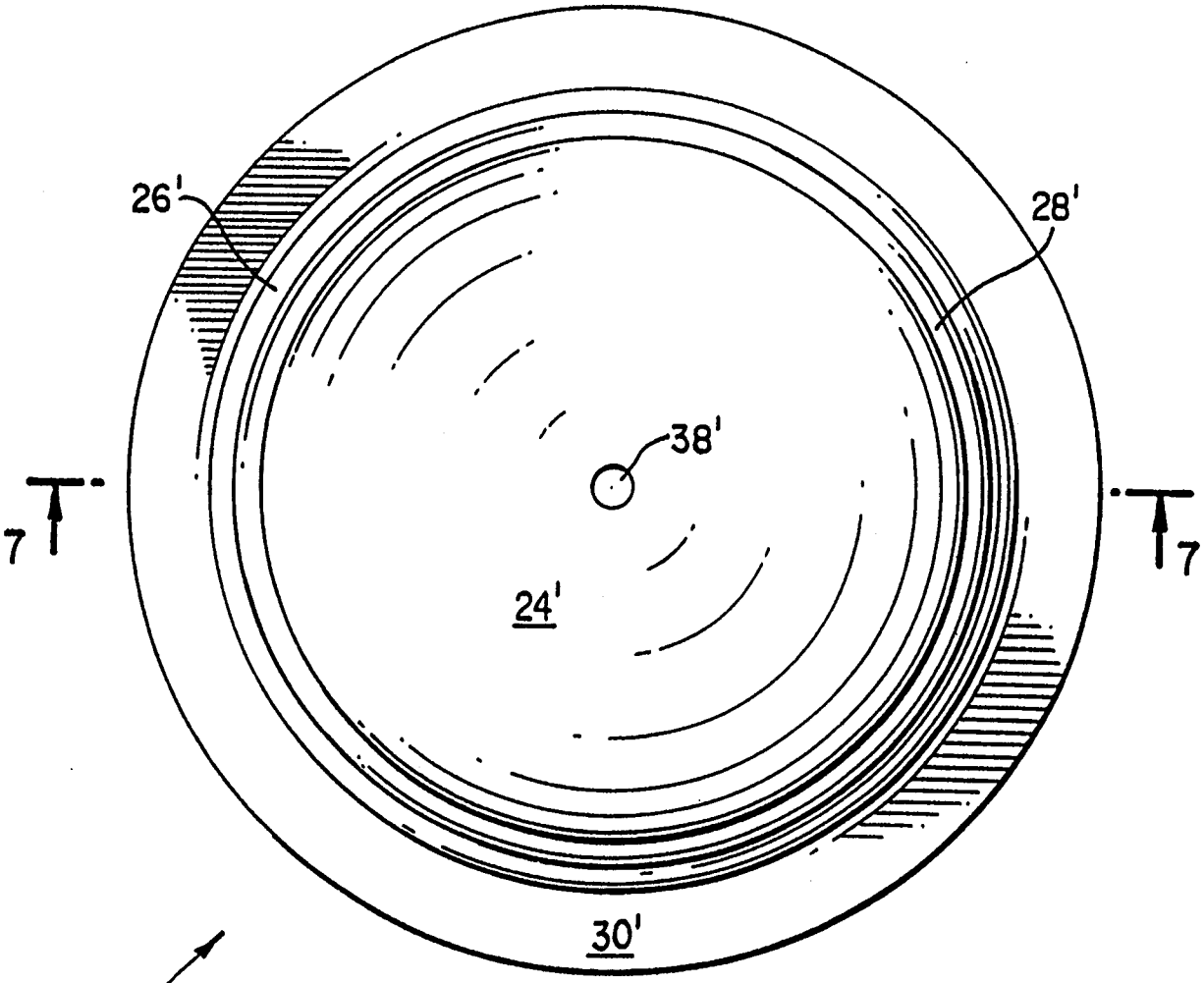
FIG. 6 is a top view of a second embodiment of the inflation mechanism of the present invention.
Figure 7:
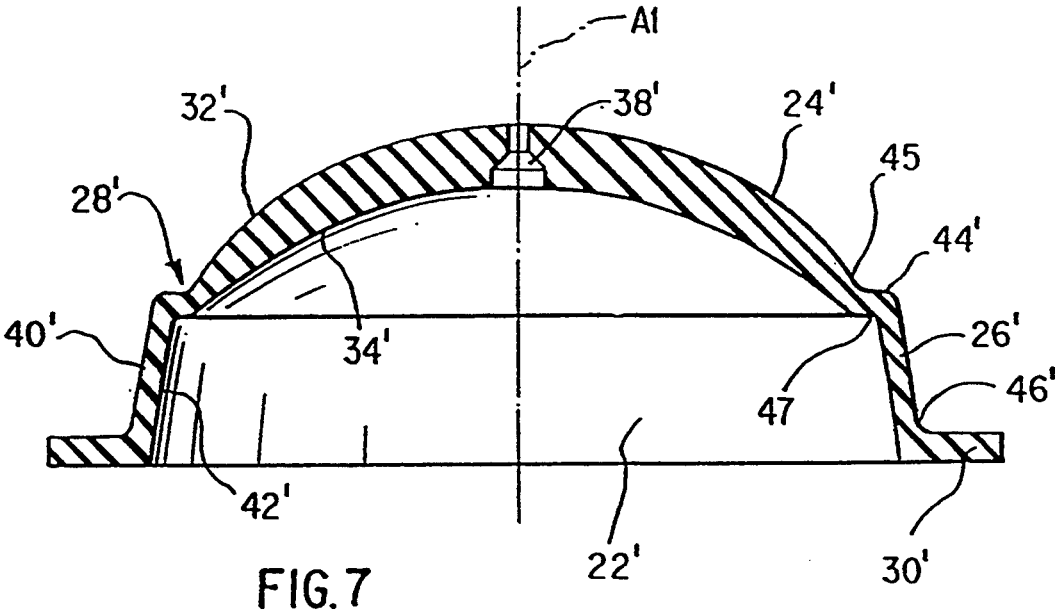
FIG. 7 is a cross-sectional view of the same taken along line 7—7 in FIG. 6.
Figure 8:
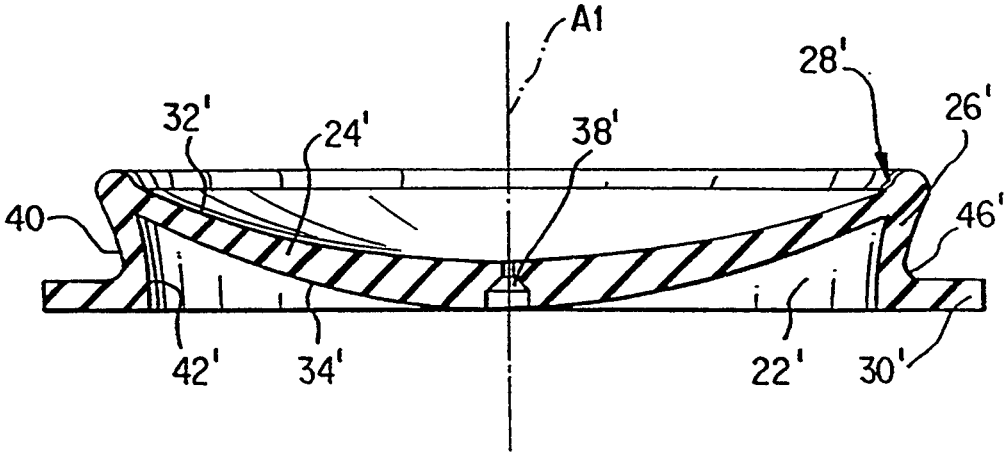
FIG. 8 is a cross-sectional view of the same upon the application of a force.

Turning now to FIGS. 6, 7 and 8, a second embodiment of the inflation mechanism of the present invention is shown. Inflation mechanism 20' is also piston-like and is also preferably made of ESTANE TM or PELLETHANE TM in the manner described above, although other suitable materials may be used. Inflation mechanism 20' generally comprises four elements: an inflation head 24', a sidewall 26' flexure means 28' and outer lip 30'.

Inflation head 24' is shaped similarly to inflation head 24 described above, that is, it is substantially circular in plan and crescent shaped in cross-section. The radius of curvature of outer surface 32' is 0.5905 inch; the radius of curvature of inner surface 34' is 0.689 inch. Similarly, inflation head 24' defines a hole 38' (or one-way valve) aligned approximately with central axis A1'. Hole 38' permits air (or other fluid) to enter the interior chamber 22' of inflation mechanism 20', as described above. The diameter of hole 38' increases from approximately 0.030 inches along outer surface 32' to approximately 1.065 inches at inner surface 42'.

Sidewall 26' is similar to sidewall 26 described above except that it is shorter in height (approximately 0.236 inch between outer lip 30' and flexure means 28'). Furthermore, the radius of curvature of outer surface 40' is approximately 1.9685 inch, while it is approximately 1.949 inch for inner surface 42'. Lip 30' is substantially identical to lip 30 described above.

Flexure means 28' is also similar to flexure means 28 described above, that is, it joins sidewall 26' and inflation head 24'. However, in this embodiment, flexure means 28' has a larger radius of curvature than flexure means 28. In particular, the radius of curvature of outer surface 45 of flexure means 28' is approximately 0.20 inches and approximately 0.01 inches for curved inner surface 47. The thickness of flexure means 28' is 0.020 inches. Inflation mechanism 20' operates substantially the same as inflation mechanism 20 described above. Furthermore, inflation mechanism 20' may be incorporated into a bladder or other fluid chamber as described above with regard to inflation mechanism 20.

The foregoing description of the preferred embodiments of the invention have been presented for purposes of illustration and description. It is not intended to be exhaustive or to limit the invention to the precise form disclosed, and obviously many modifications and variations are possible in light of the above teaching. For example, although the inflation mechanism was shown to be substantially circular in plan view, it is possible for the inflation mechanism to be a number of other shapes. In addition, the flexure means formed between the sidewall and the inflation head may be a weakened area formed of a material having less rigidity than the sidewall and the inflation head. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What I claim is:

1. An inflation mechanism comprising:

a sidewall defining a fluid-filled interior chamber;

an inflation head having a curved inner surface and a curved outer surface defining a crescent shaped cross-section, and a hole disposed at a center of said inflation head; and a concave groove disposed between said sidewall and said inflation head for allowing said inflation head to invert within said interior chamber while said sidewall remains erect, thereby displacing fluid disposed within said interior chamber.

2. The inflation mechanism of claim 1, wherein said groove extends along the entire periphery of said sidewall.

3. The inflation mechanism of claim 1, wherein said sidewall is circular in cross section.

4. The inflation mechanism of claim 1, wherein the ratio of the radius of curvature of said outer surface of said inflation head to said inner surface of said inflation head is approximately 0.60.

5. The inflation mechanism of claim 1, further comprising a lip disposed along a bottom area of said sidewall for attaching said inflation mechanism to an inflatable bladder.

6. The inflation mechanism of claim 1, wherein said sidewall has a bottom area and wherein said sidewall tapers from said bottom area to said concave groove.

7. The inflation mechanism of claim 6, wherein said sidewall has an outer surface and an inner surface and wherein said outer surface and said inner surface are curved from said flexure means to said bottom area.

8. The inflation mechanism of claim 7, wherein the ratio of curvature of said outer surface of said sidewall to said inner surface of said sidewall is approximately 1.01.

9. The inflation mechanism of claim 1, wherein said inflation head, said concave groove and said sidewall are monolithic.

10. The inflation mechanism of claim 1, wherein the material forming said inflation mechanism has a hardness within the range of approximately 80–85 durometer.

11. The inflation mechanism of claim 1, further comprising foam filling said interior chamber.

12. The inflation mechanism of claim 1, wherein said concave groove faces upwardly when said inflation head is raised and faces inwardly when said inflation head is inverted.

13. The inflation mechanism of claim 1, wherein said concave groove is of a substantially uniform thickness and is substantially the same thickness as a periphery of said sidewall and a periphery of said inflation head.

14. The inflation mechanism of claim 1, wherein said hole increases in diameter from said outer surface of said inflation head to said inner surface of said inflation head.

15. An inflation system, comprising:

(a) a bladder;

(b) an inflation mechanism in fluid communication with said bladder, said inflation mechanism having a sidewall defining a fluid-filled interior chamber; an inflation head comprising a curved inner surface and a curved outer surface defining a crescent shaped cross-section, and a hole disposed at a center of said inflation head; and a concave groove disposed between said inflation head and said sidewall for allowing said inflation head to invert within said interior chamber while said sidewall remains erect, thereby displacing fluid disposed within said interior chamber to said bladder.

16. The inflation system of claim 15, wherein said bladder and said inflation mechanism are unitary.

17. The inflation system of claim 16, wherein said inflation mechanism further comprises an outer lip disposed adjacent said sidewall and wherein said bladder and said inflation mechanism are joined along said outer lip.

18. The inflation mechanism of claim 15, further comprising foam filling said interior chamber.

19. The inflation mechanism of claim 15, wherein said concave groove faces upwardly when said inflation head is raised and faces inwardly when said inflation head is inverted.

20. The inflation mechanism of claim 15, wherein said concave groove is of a substantially uniform thickness and is substantially the same thickness as a periphery of said sidewall and a periphery of said inflation head.

* * * * *

UNITED STATES PATENT AND TRADEMARK OFFICE

CERTIFICATE OF CORRECTION

PATENT NO. : 5,435,230

DATED : July 25, 1995

INVENTOR(S) : Phillips

It is certified that error appears in the above-indentified patent and that said Letters Patent is hereby corrected as shown below:

TITLE PAGE, ITEM [63]

In the Related U.S. Application Data Section, please change "which is a continuation-in-part" to --and a continuation in part--.

Signed and Sealed this

Twenty-first Day of November, 1995

Bruce Lehman

*Attest:*

BRUCE LEHMAN

*Attesting Officer*

*Commissioner of Patents and Trademarks*